US011049382B2

(12) United States Patent
Saporito et al.

(10) Patent No.: US 11,049,382 B2
(45) Date of Patent: Jun. 29, 2021

(54) FALL DETECTION METHOD AND SYSTEM

(71) Applicant: KONINKLIJKE PHILIPS N.V., Eindhoven (NL)

(72) Inventors: Salvatore Saporito, Rotterdam (NL); Warner Rudolph Theophile Ten Kate, Waalre (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/101,165

(22) Filed: Nov. 23, 2020

(65) Prior Publication Data

US 2021/0166545 A1 Jun. 3, 2021

(30) Foreign Application Priority Data

Nov. 29, 2019 (EP) ..... 19212546

(51) Int. Cl.
*G08B 21/04* (2006.01)
*G08B 25/01* (2006.01)

(52) U.S. Cl.
CPC ..... *G08B 21/043* (2013.01); *G08B 21/0446* (2013.01); *G08B 25/016* (2013.01)

(58) Field of Classification Search
CPC ..... G08B 21/043
See application file for complete search history.

(56) References Cited

U.S. PATENT DOCUMENTS

| | | | | |
|---|---|---|---|---|
| 9,589,442 | B2 | 3/2017 | Barfield, Jr. et al. | |
| 9,805,577 | B2 * | 10/2017 | Haflinger | A61B 5/6822 |
| 10,446,017 | B1 * | 10/2019 | Gershoni | G08B 21/0492 |
| 2011/0230791 | A1 * | 9/2011 | Ten Kate | G08B 29/22 600/595 |
| 2012/0286949 | A1 * | 11/2012 | Worthington | G08B 21/0492 340/539.1 |
| 2014/0313036 | A1 * | 10/2014 | Sweeney | G08B 29/188 340/573.1 |
| 2015/0061863 | A1 | 3/2015 | Barfield, Jr. et al. | |
| 2016/0307427 | A1 * | 10/2016 | Haflinger | G08B 21/0446 |
| 2017/0352240 | A1 | 12/2017 | Carlton-Foss | |
| 2018/0000385 | A1 | 1/2018 | Heaton et al. | |
| 2018/0336773 | A1 | 11/2018 | Hanson et al. | |
| 2019/0167156 | A1 | 6/2019 | Heaton et al. | |

OTHER PUBLICATIONS

Sui, Y. et al., "Development of a Low False-Alarm-Rate Fall-Down Detection System Based on Machine Learning for Senior Health Care", University of Cincinnati, 2015.

* cited by examiner

*Primary Examiner* — Travis R Hunnings

(57) ABSTRACT

A concept for personalizing a fall detection algorithm to a particular subject. Sensor data, responsive to a fall of a subject, is obtained at the fall detector, along with feedback information responsive to a confirmation of whether the subject has fallen and/or whether the subject had not fallen. Parts of the sensor data, and corresponding portions of the feedback information, are transmitted to an external device, which generate update information for the fall detection algorithm. The update information is then used by the fall detector to update, and thereby personalize, the fall detection algorithm.

12 Claims, 4 Drawing Sheets

FALL DETECTION METHOD AND SYSTEM

CROSS-REFERENCE TO PRIOR APPLICATIONS

This Application Claims the Benefit of European Patent Application No. 19212546.6, Filed on 29 Nov. 2019. This Application is Hereby Incorporated by Reference Herein

FIELD OF THE INVENTION

The present invention relates to the field of fall detection, and in particular to improving the accuracy of detecting the fall of a subject.

BACKGROUND OF THE INVENTION

Typically, a fall detector is an embedded/wearable device that detects a fall event from a set of input signals responsive to changes in a movement of a subject, such as a change in height, speed, orientation, or motion. This information may be obtained, for example, from an air pressure sensor, an accelerometer and/or gyroscope (or other similar sensor) of the fall detector.

Traditional fall detectors operate in a two-stage process, in which a first stage comprises computing a set of features (from the input signals) associated with a detected event, and a second stage comprises evaluating the set of features, using a classifier, to decide whether or not the event is a fall. A similar approach is used by other types of detectors, such as an activity of daily living detector.

One recent development has been the introduction of fall detectors that process the set of input signals using a machine-learning method, such as a deep learning model, in order to detect the presence or absence of a fall event. Machine-learning methods have proven to have improved accuracy in correctly detecting the presence or absence of a fall event, when compared to other, more traditional approaches.

One limitation to the application of machine-learning methods is the large amount of data required to accurately train, i.e. calculate appropriate (e.g. the optimal) coefficient values of a machine learning method and the large processing power required to execute a machine-learning method, due at least to the number of parameters and/or weights inherent within a machine-learning method. This makes it difficult to realize a machine-learning based fall detector.

Cloud computing and software platforms, provided by an external server/processor, are available and typically have a much larger processing power capacity and memory size to enable appropriate training of the machine-learning method externally to the fall detector. Presently, in order to take advantage of such external servers/processors, a large amount of data needs to be transferred between the fall detector and an external server or processor. This data may include, for example, training data for training the machine-learning method (transferred from the fall detector to the external server/processor) and/or parameter/weights for a machine-learning method present on the fall detector (provided by the external server/processor).

There is an ongoing desire to reduce the amount of processing power used by a fall detector and/or amount of data transferred between a fall detector and an external server. This would enable smaller and less obtrusive fall detectors to be provided.

US 2015/061863 A1 discloses a technique for the classification of fall events for a personal emergency response (PER) device.

US 2018/000385 A1 describes a method for detecting and responding to falls.

US 2017/352240 A1 discloses a method for detecting an emergent fall.

SUMMARY OF THE INVENTION

The invention is defined by the claims.

According to examples in accordance with an aspect of the invention, there is provided a computer-implemented method for updating, at a fall detector, a fall detection algorithm that processes sensor data to predict the occurrence of one or more fall events within the sensor data.

The computer-implemented method comprises: obtaining, at the fall detector, sensor data from one or more sensors that monitor the subject, wherein the sensor data is responsive to a fall of the subject; obtaining, at the fall detector, feedback information that is responsive to a user or automated confirmation of the occurrence or non-occurrence of a fall; in response to a trigger, transmitting, from the fall detector to the external device: one or more parts of the sensor data from the fall detector to an external device for training a fall detection algorithm, each part of the sensor data corresponding to a particular time period; and a respective one or more portions of the feedback information, each portion of the feedback information temporally corresponding to the particular time period of a respective part of the sensor data, the portion of the feedback information thereby being responsive to a user or automated confirmation of the occurrence or non-occurrence of a fall during the particular time period of said respective part of the sensor data; processing, at the external device, the one or more parts of the sensor data and the one or more portions of the feedback information to generate update information for the fall detection algorithm, wherein the update information is only usable (by the fall detector) for updating a subset of coefficients of the fall detection algorithm; transmitting the update information from the external device to the fall detector; and updating, at the fall detector, the fall detection algorithm based on the received update information from the external device.

The present invention relates to a method of improving a fall detection algorithm of a fall detector by using an external device to modify the fall detection algorithm, whilst reducing the amount of data sent between the fall detector and the external device. One or more parts of sensor data are transmitted to the external device (along with corresponding feedback information that is able to indicate whether a fall has or hasn't actually occurred). This effectively provides new training data for training the fall detection algorithm.

The external device then generates update information for updating the fall detection algorithm, e.g. by further training a copy of the fall detection algorithm based on the newly transmitted sensor data and feedback information, in combination with any pre-existing sensor data and feedback information (i.e. collected previously from same user, or in general from other users). The update information is then passed back to the fall detector to update the fall detection algorithm.

By dividing the sensor data into parts (i.e. rather than transmitting all of the sensor data), a reduction is made in the amount of data sent from the fall detector to the external device. The invention is particularly advantageous when a communication between the fall detector and the external device takes place at least partially over a wireless channel, as data transmission costs will be at a premium.

The feedback information may allow a user, or automated process, to indicate the occurrence and/or non-occurrence of a fall. The feedback information may be generated via a user interface and/or a processing system.

In some examples, a user interacting with a user interface indicates that the user is identifying the occurrence of a fall. In other examples, a user interacting with a user interface indicates that the user is identifying the non-occurrence of a fall (e.g. to reject or cancel a predicted fall by a fall detection algorithm). The user may be the subject monitored by the fall detector, or another (external) user, such as a friend/relative, a clinician responsible for the subject or a user of a third party system (such as operator of a call center with which the subject can communicate following a fall).

Thus, the "user" does not need to be the subject monitored by the fall detector.

In some examples, the occurrence of a fall can be confirmed by a lack of movement/motion within a certain time period after a fall is detected. Other automated processes for identifying the occurrence of a fall will be apparent, e.g. by monitoring emergency callouts to the subject (which would indicate the occurrence of a fall), by monitoring call-center records or the like.

Suitable examples of an external device include a cloud-computing system and/or a remote server and/or a portable processing unit distinct from the fall detector (e.g. in a smartphone). The fall detector may be a portable and/or wearable device that processes sensor data to predict the occurrence of a fall. The invention is particularly advantageous when the fall detector is wearable, as there is a desire to provide small, low-power fall detectors, which may not have the processing capability and/or memory storage to refine or train a fall detection algorithm appropriately.

The external device is separate and distinct from the fall detector. Preferably, the communications between the external device and the fall detector take place at least partially over a wireless communication channel.

Confirmation of a non-occurrence of a fall may effectively be a rejection of a predicted fall event. Similarly, confirmation of the occurrence of a fall may effectively act as a rejection of a predicted non-fall event.

To further reduce the amount of data transferred between the fall detector and the external device, the external device is adapted to train or modify only a subset of the coefficients of the fall detection algorithm, i.e. only some of the coefficients of the fall detection algorithm. The update information is then generated and is usable for updating only these coefficients. Thus, the external device trains/modifies only part of the fall detection algorithm using the information from the fall detector (i.e. rather than the entirety of the fall detection algorithm). This enables the external device to maintain a level of control over the processing performed by the fall detection algorithm, whilst reducing the amount of data transmitted.

Thus, the update information may be unusable for updating all coefficients of the fall detection algorithm.

The step of updating, at the fall detector, the fall detection algorithm thereby comprises updating only some of the coefficients, i.e. the subset of coefficients, of the fall detection algorithm using the update information obtained from the external device.

In other words, the external device is configured so that, responsive to information received from the fall detector alone, it is only able to update a subset of the coefficients of the fall detection algorithm. In particular examples, the update information is data resulting from (re)training the fall detection algorithm further using information received from the fall detector alone.

The fall detection algorithm may comprise a machine-learning algorithm formed of a plurality of layers, and the update information may consist of information for updating only a subset of the plurality of layers of the machine-learning algorithm. In other words, the external device may (responsive to information received from the fall detector) only train a subset of layers for a machine-learning algorithm formed of a plurality of layers.

The method may further comprise a step of processing, at the external device, the one or more parts of the sensor data and the one or more portions of the feedback information to determine which part of the fall detection algorithm to update.

Thus, the part of the fall detection algorithm that is updated may depend upon characteristics of the one or more parts of the sensor data, for example, the number of parts of the sensor data that have been transmitted. As an example, in an embodiment, the more data received by the external device, the greater the size of the part of the fall detection algorithm to update.

The method may further comprise a step of processing, at the fall detector, sensor data using the fall detection algorithm to predict the occurrence of a fall event within the sensor data, wherein each one or more parts of the sensor data comprises a part of the sensor data corresponding to a predicted fall event within the sensor data.

Thus, in preferred embodiments, each part of the sensor data transmitted to the external device corresponds to a part that triggered the identification of a fall event by the fall detection algorithm. This ensures that the information provided to the external device can assist in the training a fall detection algorithm to better discriminate between fall events and non-fall events. The approach improves the efficiency of uploading data to the external device, (as only data that might lead to decrease in detection errors and associated costs are transferred, rather than transferring all sensor data).

In particular, the feedback information may be able to indicate whether the predicted fall event was predicted correctly, e.g. as a user input may enable a user to identify whether a predicted fall event was correct or not. This information can be used to improve an accuracy of the fall detection algorithm.

In some embodiments, each one or more parts of the sensor data comprises a part of the sensor data corresponding to a portion of the feedback information that indicates a user or automated confirmation of the occurrence or non-occurrence of a fall.

In other words, each one or more part of the sensor data may temporally correspond to a time at which a user or automated process actively provides an indication of the occurrence of non-occurrence of a fall (e.g. when the user actively interacts with the user interface). This ensures that the information passed to the external device for training accurately reflects a "real-life" piece of information (i.e. data that actively illustrates whether sensor data is associated with a fall or not).

Of course, in some embodiments, each one or more parts of the sensor data comprises a part of the sensor data corresponding to a predicted fall event within the sensor data and/or corresponding to a portion of the feedback information that indicates a user or automated confirmation of the occurrence or non-occurrence of a fall.

In some embodiments, the trigger comprises: a user input from a user interface indicating a desire to update the fall detection algorithm; the feedback information indicating confirmation of the occurrence or non-occurrence of a fall more than a first predetermined number of times, wherein the first predetermined number of times is greater than one; the feedback information indicating confirmation of the occurrence or non-occurrence of a fall more than a second predetermined number of times within a first predetermined time period, wherein the second predetermined number of times is greater than one; and/or a signal received from the external server.

In some examples, the method further comprises: a step of processing, at the fall detector, sensor data using the fall detection algorithm to predict the occurrence of a fall event within the sensor data; and processing the predicted occurrences of a fall event and the feedback data to calculate an accuracy measure of the fall detection algorithm; and wherein the trigger comprises the accuracy measure falling outside a first predetermined range.

The step of transmitting the update information may be performed responsive to a second trigger. In this embodiment, the update information is only passed to the fall detector if a second trigger is identified at the external device. This can enable further control over the passing of data from the external device to the fall detector, for example, to restrict a frequency or amount of data sent.

The method may further comprise a step of determining a total amount of data transferred to the fall detector within a second predetermined time period, wherein the second trigger comprises the total amount of data being below a second predetermined value.

The method may comprise a step of, at the external device, processing the update information to predict an expected increase in performance of the fall detection algorithm, wherein the second trigger comprises the expected increase being greater than a third predetermined value.

The update information may comprise one or more coefficients for replacing respective one or more coefficients of the fall detection algorithm.

According to examples in accordance with an aspect of the invention, there is also provided a computer program comprising code means for implementing any herein described method when said program is run on a processing system.

According to examples in accordance with an aspect of the invention, there is provided a fall detection system for updating, at a fall detector, a fall detection algorithm that processes sensor data to predict the occurrence of one or more fall events within the sensor data.

The fall detection system comprises: a fall detector comprising: one or more sensors that monitor the subject to generate sensor data, wherein the sensor data is responsive to a fall of the subject; a fall detection processor adapted to process the sensor data, using a fall detection algorithm, to predict the occurrence of one or more fall events within the sensor data; an interface adapted to obtain feedback information that is responsive to a user or automated confirmation of the occurrence or non-occurrence of a fall; a transceiver system adapted to, in response to a trigger, transmit, from the fall detector to the external device: one or more parts of the sensor data from the fall detector to an external device for training a fall detection algorithm, each part of the sensor data corresponding to a particular time period; and a respective one or more portions of the feedback information, each portion of the feedback information temporally corresponding to a particular time period of a respective part of the sensor data, the portion of the feedback information thereby being responsive to a user or automated confirmation of the occurrence or non-occurrence of a fall during the particular time period of said respective part of the sensor data.

The fall detection system also comprises an external device adapted to: process the one or more parts of the sensor data and the one or more portions of the feedback information to generate update information for the fall detection algorithm, wherein the update information is only usable for updating a subset of coefficients of the fall detection algorithm; and transmit the update information from the external device to the fall detector.

The transceiver system of the fall detector is further adapted to receive the update information and the fall detector is adapted to, update the fall detection algorithm based on the received update information from the external device.

The external device itself may be able to handle the generation of respective update information for a plurality of different fall detectors, i.e. act as a centralized system.

These and other aspects of the invention will be apparent from and elucidated with reference to the embodiment(s) described hereinafter.

BRIEF DESCRIPTION OF THE DRAWINGS

For a better understanding of the invention, and to show more clearly how it may be carried into effect, reference will now be made, by way of example only, to the accompanying drawings, in which.

DETAILED DESCRIPTION OF THE EMBODIMENTS

Figure 1:
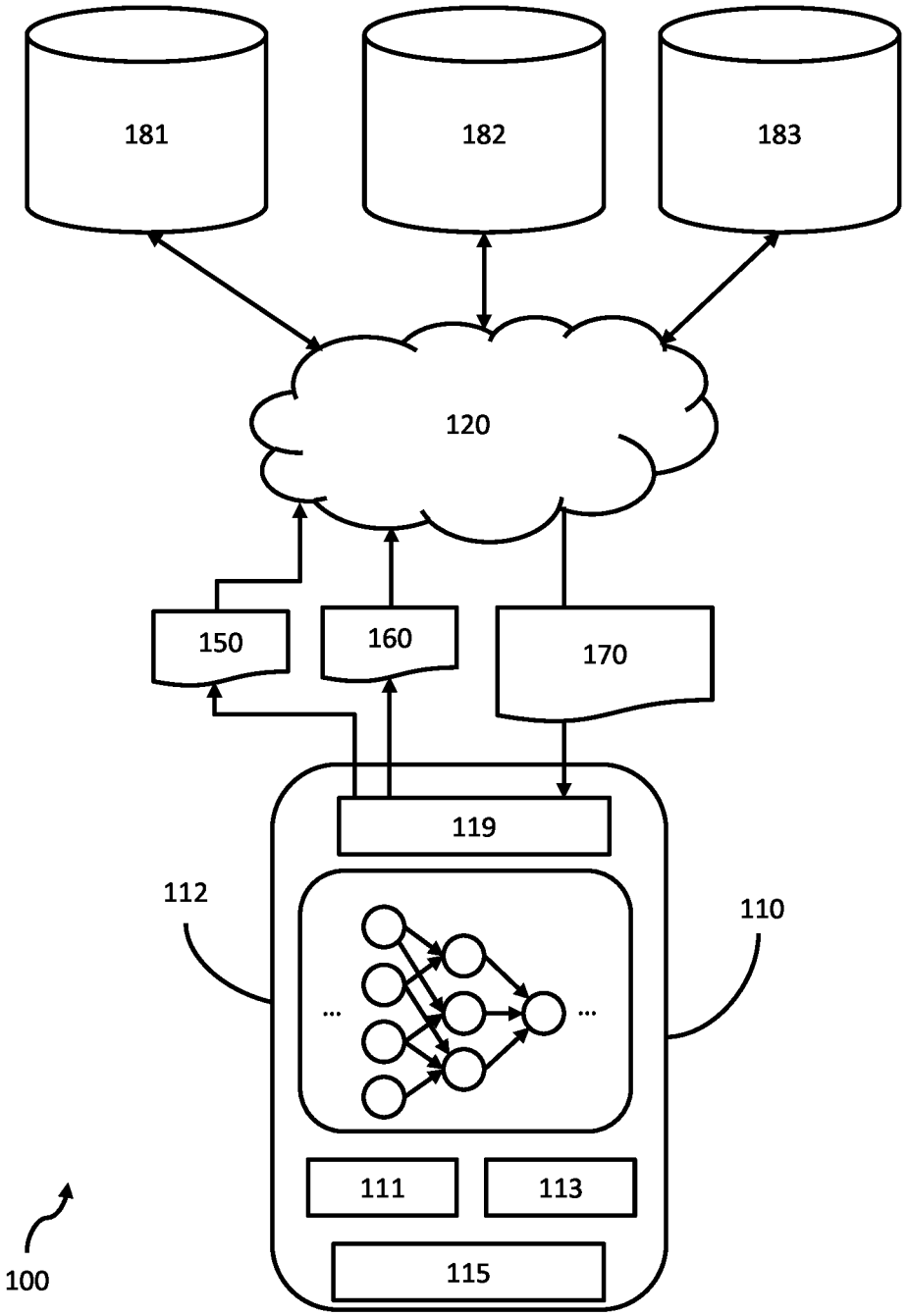
FIG. 1 conceptually illustrates a system according to an embodiment of the invention.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

The invention provides a concept for personalizing a fall detection algorithm to a particular subject. Sensor data, responsive to a fall of a subject, is obtained at the fall detector, along with feedback information responsive to a confirmation of whether the subject has fallen and/or whether the subject had not fallen. Parts of the sensor data, and corresponding portions of the feedback information, are transmitted to an external device, which generate update information for the fall detection algorithm. The update information is then used by the fall detector to update, and thereby personalize, the fall detection algorithm.

The present invention relies on the recognition that an amount of data transferred between a fall detector and an external device, that updates a fall detection algorithm for the fall detector, can be reduced through appropriate selection of data transmitted between the two elements. In particular, by only using parts of the sensor data, the total amount of sensor data transmitted to the external device can be reduced, whilst still allowing the external device to personalize the fall detection algorithm.

Embodiments may be employed to personalize fall detectors, such as those used in nursing homes or with vulnerable people.

FIG. 1 illustrates a system 100 according to an embodiment of the invention. The system comprises a fall detector 110 and an external device 120, such as a cloud-computing system, server or any other remote device, such as a mobile phone or other handheld processing system.

The fall detector 110 comprises one or more sensors 111 adapted to monitor a subject and generate sensor data. The sensor data is responsive to a fall of the subject. Suitable example sensors includes air pressure sensors, accelerometers and/or gyroscopes/gyrometers. The sensor data may comprise, for example, any data responsive to a change in height, speed, orientation, or motion.

The fall detector comprises a fall detection processor 112 adapted to process the sensor data and predict whether a fall has occurred. The fall detection processor may, as illustrated, perform this process using a fall detection algorithm that processes sensor data to predict the occurrence of one or more fall events within the sensor data. A fall event is a marker or indicator that indicates the predicted occurrence of a fall from the sensor data.

Typically, the fall detection algorithm is iteratively applied to chunks of the sensor data, in order to predict whether a fall has occurred during the point/period of time covered by that chunk of sensor data, i.e. whether a fall event has occurred. This iterative application is typically performed using a windowing process, so that the fall detection algorithm processes a most recently available chunk of sensor data to predict whether a fall has occurred in that chunk of sensor data. The period of time covered by the chunk of sensor data may be predetermined, e.g. 5 s, 10 s or 20 s.

Suitable fall detection algorithms make use of, for example, neural networks. However, other fall detection algorithms are contemplated, such as a decision tree, random forest, support vector machines, naïve Bayesian classifiers, and/or deep neural networks, including cell structures like CNN and LSTM.

In particular examples, a fall detection algorithm may compute a set of feature values from the sensor data (e.g. a set of values that can be indicative of a fall) and apply a classifier or other machine-learning model to the set of feature values to determine whether or not a fall event has occurred. Example classifiers include neural networks, decision tree, random forest, support vector machines, and naïve Bayesian classifiers.

Other examples may simply apply a machine-learning model directly to the raw chunk of sensor data in order to predict whether or not a fall event has occurred. Such examples may make use of, for example, a deep neural network.

In some embodiments, the fall detector is adapted to output a user-perceptible alarm at an alarm module 113 upon detection of a fall event. The user perceptible alarm may, for example, comprise an audible and/or visual alarm to alert persons in the vicinity of the subject that a fall has occurred.

In some examples, the alarm module 113 comprises a transmitter that outputs an alarm signal (e.g. to an external interface) in order to alert a remote user of a fall of the subject. The remote user may then be able to arrange help for the subject. This alarm signal may be output wirelessly, e.g. to an external alarming module.

The fall detector 110 further comprises an interface 115. The interface is adapted to obtain feedback information that is responsive to a confirmation of the occurrence and/or non-occurrence of a fall. The confirmation may be a user confirmation or an automated confirmation. The "user" may be the subject monitored by the fall detector 110 and/or an external user, such as a call center operator, clinician responsible for the subject and/or a friend/relative of the monitored subject.

The feedback information may be responsive to confirmation of the occurrence of a fall only. Thus, in this scenario, the feedback information may have at least two states, "confirmation of a fall" or "no confirmation of a fall".

In some embodiments, the feedback information may be responsive to confirmation of the non-occurrence of a fall. Thus, in this scenario, the feedback information may have at least two states: "no confirmation of a non-fall" or "confirmation of a non-fall".

In yet other embodiments, the feedback information may be responsive to the confirmation of the occurrence of a fall and the confirmation of the non-occurrence of a fall. Thus, in this scenario, the feedback information may have at least three values, "no confirmation of a fall or non-fall", "confirmation of a fall", "confirmation of a non-fall". Thus, the feedback information can indicate whether or not a fall and/or non-fall is confirmed, and indicate (when a fall or non-fall is confirmed) whether a fall is confirmed or a non-fall is confirmed.

In one embodiment, the interface is a user interface that enables a user to provide a user input as the feedback information. Thus, a user may be able to indicate the occurrence and/or non-occurrence of a fall. In some examples, the user input is only able to confirm either the occurrence of a fall or the non-occurrence of a fall.

In an embodiment, the interface is adapted to receive feedback information from another external device, e.g. from a user monitoring the subject with a camera or otherwise interacting with the subject (e.g. through an emergency help line or panic alarm process). In particular examples, this other external device is controlled by a person in a call center responding to the detected fall.

In yet another embodiment, the interface may be adapted to generate feedback information using the sensor data. For example, the fall detector may be adapted to predict the occurrence of a fall event. After the fall detector predicts the occurrence of a fall event, the interface may monitor the sensor data to detect whether there is movement indicative that a fall has not occurred (as movement may indicate that no fall has occurred). By way of example, movement of more than a predetermined amount may indicate that no fall has occurred, whereas movement of less than a predetermined amount may indicate that a fall has occurred. The interface may, for example, be adapted to modify the feedback information to indicate the occurrence of a fall if no movement is detected within a certain time period (e.g. a minute). The certain time limit is preferably longer than the period of time covered by the chunk of sensor data.

The feedback information may be formed by any combination of the example feedback information provided, e.g. each contributing to an aspect of the feedback information.

The fall detector 110 is adapted to send one or more parts of the sensor data 150 to the external device 120. This process is performed using a transceiver system 119. The transceiver system may communicate with the external device 120 using a wireless communication protocol. Suitable wireless communication protocols that may be used to communicate with the external device include an infrared link, Zigbee, Bluetooth, a wireless local area network protocol such as in accordance with the IEEE 802.11 standards, a 2G, 3G or 4G telecommunication protocol, and so on. Other formats will be readily apparent to the person skilled in the art.

In this way, not all of the sensor data obtained by the fall detector (from the one or more sensors 111) is sent to the external device 120. In particular, the one or more parts of the sensor data 150 do not form the entire sensor data, i.e. together they form only part of or a subset of the sensor data obtained from the sensors 111.

The fall detector 110 is also adapted to send, using the transceiver system 119, one or more portions of the feedback information 160 to the external device 120. Each portion of the feedback information temporally corresponds to a respective part of the sensor data.

Temporally corresponds is here used to mean that the portion of feedback information relates to or provides information about a same point or period of time as the part of sensor data to which it corresponds, i.e. to which it is associated. That is, the portion of feedback information corresponding to a part of the sensor data is responsive to a confirmation of the occurrence and/or non-occurrence of a fall during the point or period of time covered by the said corresponding part of the sensor data (i.e. responsive to a confirmation of a fall or non-fall during a time period covered by the corresponding part of the sensor data).

The sending of the one or more parts of the sensor data and the corresponding one or more portions of the feedback information may be performed in response to a trigger, suitable examples of which will be provided later. The trigger prevents the part(s) of the sensor data being unconditionally transmitted to the external device, thereby enabling control over the amount of data transmitted to the external device and/or when data is transmitted to the external device.

The external device 120 thereby receives parts of sensor data 150 and corresponding parts of feedback information 160.

The external device 120 is able to use this information to generate update information 170 for the fall detection algorithm (employed by the fall detector 110). In particular examples, the external device may generate new coefficients for the fall detection algorithm of the fall detector.

To perform this action, the external device may have a copy of the fall detection algorithm employed by the fall detector. This may be provided, for example, by a manufacturer of the fall detector, be stored in a dedicated database and/or be supplied by the fall detector itself (e.g. identifying a type of fall detection algorithm and/or coefficients used in the fall detection algorithm). If the fall detector provides the fall detection algorithm to the external device, this may be performed only once, e.g. upon the fall detector connecting to a network so it can communicate with the external device, upon a user request and/or periodically (to ensure the external device has the latest version of the fall detection algorithm).

The external device 120 may then further train or retrain the copy of the fall detection algorithm using the one or more parts of the sensor data and the corresponding portions of feedback information. The further trained or retrained fall detection algorithm can then be used to define update information, for updating the original fall detection algorithm on the fall detector.

As previously explained, the fall detection algorithm is adapted to process a chunk of sensor data in order to detect the occurrence of a fall within that chunk of sensor data. By using actual sensor data of the user, and the accompanying confirmation of a fall or non-fall, the copy of fall detection algorithm can be improved or personalized to the user.

The update information may comprise information or instructions that can be used by the fall detector to modify the fall detection algorithm, of the fall detector, to match or correspond to the further trained or retrained fall detection algorithm of the external device. Further examples and details on how to generate the update information, and the content of the update information, will be provided later.

The update information 170 is transferred to the fall detector 110, by the external device 120, which receives it at the transceiver system 119. The fall detector 110, e.g. the fall detection processor 112, uses the update information to update its fall detection algorithm. The transferring of the update information by the external device 120 to the fall detector 110 may be performed only in response to a second trigger, of which suitable examples will be provided later.

In this way, the external device 120 is able to update the fall detection algorithm used by the fall detector using sensor data obtained by the sensors of the fall detector. This results in the fall detection algorithm being personalized to the subject monitored by the fall detector and/or the fall detector itself. Thus, the performance of the fall detector can be improved without needing to perform resource-intensive processing at the fall detector itself.

As only parts of the sensor data (and the corresponding portion of the feedback information) are transmitted, the total amount of data transferred between the fall detector and the external device is reduced.

FIG. 1 further illustrates one or more databases that can be used during the training of the copy of the fall detection algorithm. The external device 120 can be adapted to communicate with each of these one or more databases. Each database is optional, or serves to illustrate a capability of the external device 120.

A first database 181 stores coefficients of the fall detection algorithm used by the fall detector, so that the external device is able to obtain a copy of the fall detection algorithm. The first database 181 may, for example, store coefficients of different fall detection algorithms used by different fall detectors, so that the external device is able to identify and extract the coefficients of the fall detection algorithm of the fall detector 110, e.g. using an identity of the fall detector.

A second database 182 stores additional training data for the fall detection algorithm. The additional training data may comprise, for example, training data used to originally train the fall detection algorithm and/or training data obtained from other fall detectors (e.g. from other fall detectors that monitor subjects having similar demographic information to the subject monitored by the fall detector 110). The additional training data may be used when training the fall detection algorithm at the external device, in order to improve the performance of the fall detection algorithm.

A third database 183 may store performance information of different fall detection algorithms, such as the fall detection algorithm used by the fall detector. This information can be used to control the second trigger, and its use will be explained in more detail later.

Figure 2:
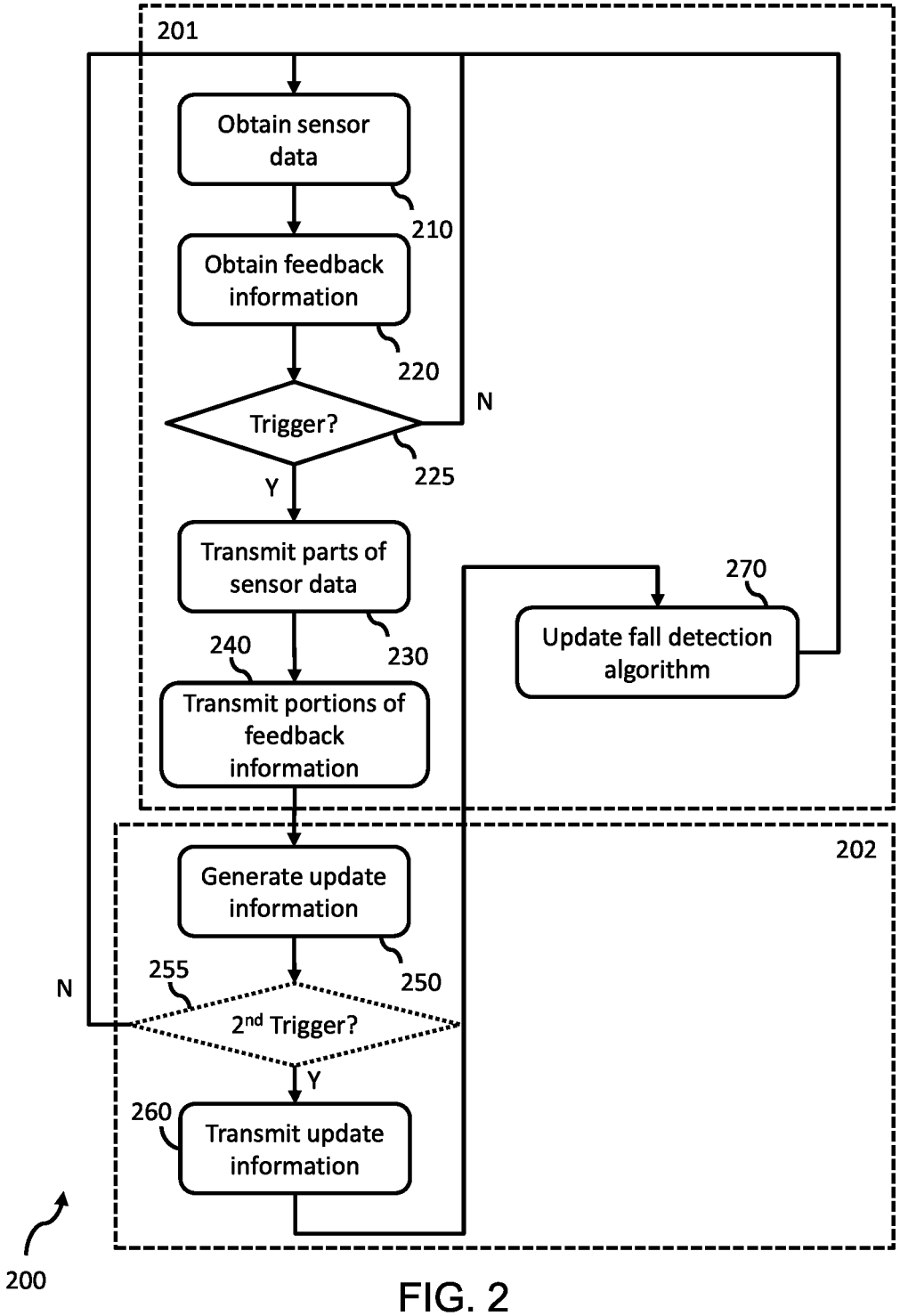
FIG. 2 is a flowchart illustrating a method according to an embodiment of the invention.

A full working example of a process of updating a fall detection algorithm shall now be described with reference to FIG. 2, which illustrates a method 200 of the invention.

The method 200 is performed by the fall detector (which steps are contained in a first set 201) and the external device (which steps are contained in a second set 202).

The method 200 comprises a first step 210 of obtaining sensor data, from one or more sensors of the fall detector. Embodiments of the sensor data, and the one or more sensors have previously been described.

The method 200 comprises a second step 220 of receiving feedback information. The feedback information is responsive to a confirmation of the occurrence and/or non-occurrence of fall. As previously described, the feedback information effectively indicates whether or not there is a confirmation that a fall has occurred and/or whether or not there is an confirmation that a fall has not occurred. The feedback information may be obtained directly at the fall detector (e.g. by a user interacting with the fall detector or by an automatic processing of the fall detector) or received from a remote device.

The method 200 then comprises a step 225 of determining whether or not there is a trigger. Examples of a suitable trigger include receiving a user input at the fall detector and/or a signal from the external server.

Another example of a suitable trigger is the feedback information indicating the confirmation of the occurrence or non-occurrence of a fall more than a first predetermined number of times, wherein the first predetermined number of times is greater than one, e.g. 10 or 20.

Yet another example of a suitable trigger is the feedback information indicating confirmation of the occurrence or non-occurrence of a fall more than a second predetermined number of times within a first predetermined time period, wherein the second predetermined number of times, e.g. more than 5 times within a 1 hour period, or more than 10 times within a day.

Other suitable triggers will be apparent to the skilled person.

Upon identifying the occurrence of a trigger, the fall detector sends/transmits one or more parts of the sensor data to the external device, in step 230, and sends/transmits the corresponding one or more portions of the feedback information to the external device, in step 240. Otherwise, the method reverts back to step 210.

The method 200 may comprise a step (not shown) of determining or selecting one or more parts of the sensor data for transmittal, and a step (not shown) of determining the one or more corresponding portions of the feedback information for transmittal.

The determining of the one or more parts of the sensor data that will be transmitted (and the corresponding portions of the feedback information) may be performed before or after a trigger is detected. Preferably, this step is performed before the trigger, so that unused sensor data and feedback information (i.e. parts of the sensor data and feedback information that will not be transmitted) can be discarded to reduce memory storage needs.

In some embodiments, each one or more parts of the sensor data corresponds to a chunk of the sensor data for which the fall detection algorithm predicted the occurrence of a fall. That is, a chunk of sensor data that, when processed by the fall detection algorithm, resulted in the fall detection algorithm predicting the occurrence of a fall. Each part of the sensor data may contain a respective chunk of the sensor data, and may optionally consist of only of a respective chunk of the sensor data (processed by the fall detection algorithm).

In some embodiments, the one or more parts of the sensor data correspond to parts of the sensor data that temporally correspond to portions of the feedback information that confirmed the occurrence or non-occurrence of a fall. The feedback information indicates whether there is confirmation of the occurrence of a fall and/or confirmation of the non-occurrence of a fall. This effectively provides example output data that can be used to train the fall detection algorithm. This embodiment thereby improves the usability of the one or more parts of the sensor data.

In some embodiments, the one or more parts of the sensor data correspond to parts of the sensor data that met both of these criteria, i.e. that the fall detection algorithms predicted the occurrence of a fall using that part of the sensor data and that the feedback information (actively) confirmed the occurrence or non-occurrence of a fall.

The size of the period of time covered by each part of the sensor data may be equal to (or a integer multiple of) the size of period of time covered by each chunk of sensor data processed by the fall detection algorithm to predict whether a fall has occurred. This ensures that the external device is provide with appropriately sized parts of sensor data for training the fall detection algorithm.

In preferred examples, each part of the sensor data is a chunk of the sensor data that was processed by the fall detection algorithm.

The external device 120 receives the one or more parts of the sensors data and the corresponding one or more portions of the feedback information. The external device 120 then, in a step 250 generates update information based on the received data and information. The update information is for updating the fall detection algorithm, i.e. to replace the existing fall detection algorithm of the fall detector with a new fall detection algorithm.

In a specific example, the fall detection algorithm is a machine-learning algorithm, such as a neural network or support vector machine. Several machine-learning algorithms, and neural networks in particular, are formed of a plurality of layers, each layer having, or being a group of, one or more coefficients that can be modified or trained to modify the sensitivity, accuracy and/or efficiency of the machine-learning method.

Generating updating information may comprise further training or retraining a copy of the fall detection algorithm using the one or more parts of the sensor data and the corresponding portions of the feedback information. The further trained or retrained copy of the fall detection algorithm can be used to define update information, e.g. the update information may comprise information for adapting the original fall detection algorithm to form the further trained or retrained fall detection algorithm.

Methods of training a machine-learning algorithm to improve its accuracy are well known. Typically, such methods comprise obtaining a training dataset, comprising training input data entries and corresponding training output data entries. The machine-learning algorithm is then applied to each input data entry to generate predicted output data entries. An error between the predicted output data entries and corresponding training output data entries is used to modify the machine-learning algorithm, and in particular coefficients of the machine-learning algorithm. This process can repeated until the error converges, and the predicted output data entries are sufficiently similar (e.g. ±1%) to the training output data entries. This is commonly known as a supervised learning technique.

For example, where the machine-learning algorithm is formed from a neural network, (coefficients of) the mathematical operation of each neuron may be modified until the error converges. Known methods of modifying a neural network include gradient descent, backpropagation algorithms and so on.

In the context of training the fall detection algorithm using the part(s) of the sensor data and the portion(s) of the feedback information, the training input data entries here comprise the part(s) of the sensor data and the training output data entries comprise to the temporally corresponding portion(s) of the feedback information.

In this way, the data/information transmitted from the fall detector to the external device can be used to train a copy of the fall detection algorithm, thereby generating new coefficients for the fall detection algorithm. These new coefficients can form the update information, or can be used to generate instructions for modifying the original fall detection algorithm that form the update information.

In other words, the data/information transmitted from the fall detector to the external device contributes to a training dataset for training a fall detection algorithm (externally to the fall detector). The trained fall detection algorithm is used to generate update information for modifying the (original) fall detection algorithm used by the fall detector, e.g. to align with the externally trained fall detection algorithm.

In some examples, the method comprises a further step (not shown) of generating additional/second update information using additional information from other (similar) fall detectors to retrain or further train the fall detection algorithm. This additional information may comprise, for example, respective one or more parts of sensor data and one or more portions of feedback information from each other fall detector.

For example, the additional/second update information may be generated further based on additional information obtained from fall detectors of a same type or version as the fall detector, e.g. to account for differences in fall detection accuracy across different types of fall detector.

As another example, the additional/second update information may be generated further based on additional information obtained from fall detectors monitoring a subjects sharing a similar demographic to the subject monitored by the (original) fall detector. This helps provide additional data that can be used to train the fall detection algorithm and personalize the fall detection algorithm to the particular type of subject.

The additional information, along with the information obtained from the fall detector may contribute to a training dataset that is used, by the external device, to (further or re-)train a fall detection algorithm. The fall detection algorithm trained by the external device is used to generate combined update information for modifying a fall detection algorithm stored (and used) by the fall detector.

The update information (and, if present, the additional/second update information), e.g. comprising new coefficients for the fall detection algorithm or instructions for modifying the original fall detection algorithm, is then transmitted to the fall detector in a step 260.

The update information and additional/second update information, if present, may be transmitted at a same time, e.g. combined and transmitted at a same time, or separately (e.g. when available).

In some embodiments, step 260 is only performed if a second trigger is identified in a step 255.

The second trigger may comprise, for example, the total amount of data transferred to the fall detector (from the external device) within a second predetermined time period being below a second predetermined value. This reduces an amount of data sent to the fall detector by the external device.

In some examples, the external device is adapted to calculate a predicted or expected increase in the performance of the fall detection algorithm. This may be performed by testing the modified fall detection algorithm at the external device and the unmodified fall detection algorithm at the external device using test data, and comparing the results of the test. Appropriate methods of testing a performance (e.g. accuracy, efficiency and/or sensitivity) of a fall detection algorithm will be apparent to the skilled person. In such embodiments, the second trigger may be the expected increase being greater than a third predetermined value.

In some examples, the update information is itself continually updated (e.g. if new data/information is transmitted to the external device) until the second trigger is identified. The fall detector then uses the received update information to update the fall detection algorithm, in a step 270.

To further reduce an amount of data transmitted between the fall detector and the external device, the (data) size of the update information may be restricted.

To restrict the size of the update information, the update information may be adapted to only modify a portion of the fall detection algorithm. For example, if the fall detection algorithm is formed of a plurality of layers, the update information may update only a subset (i.e. not all) of the layers. In a working example, the update information may comprise coefficients for only a subset of the layers of a fall detection algorithm.

By way of further example, the external device may be adapted to only modify a subset of coefficients when training the copy of the fall detection algorithm. In this way, the amount of data contained in the update information is reduced (as the number of coefficients will be reduced). The subset of coefficients comprises only some of the coefficients (i.e. not all of the coefficients) of the fall detection algorithm.

Thus, when generating the update information, the external device may be adapted to only modify a portion of the fall detection algorithm when further training or retraining the fall detection algorithm. In particular, the external device may be adapted to only modify a subset of the coefficients (of all possible coefficients) of the fall detection algorithm using the update information.

Figure 3:
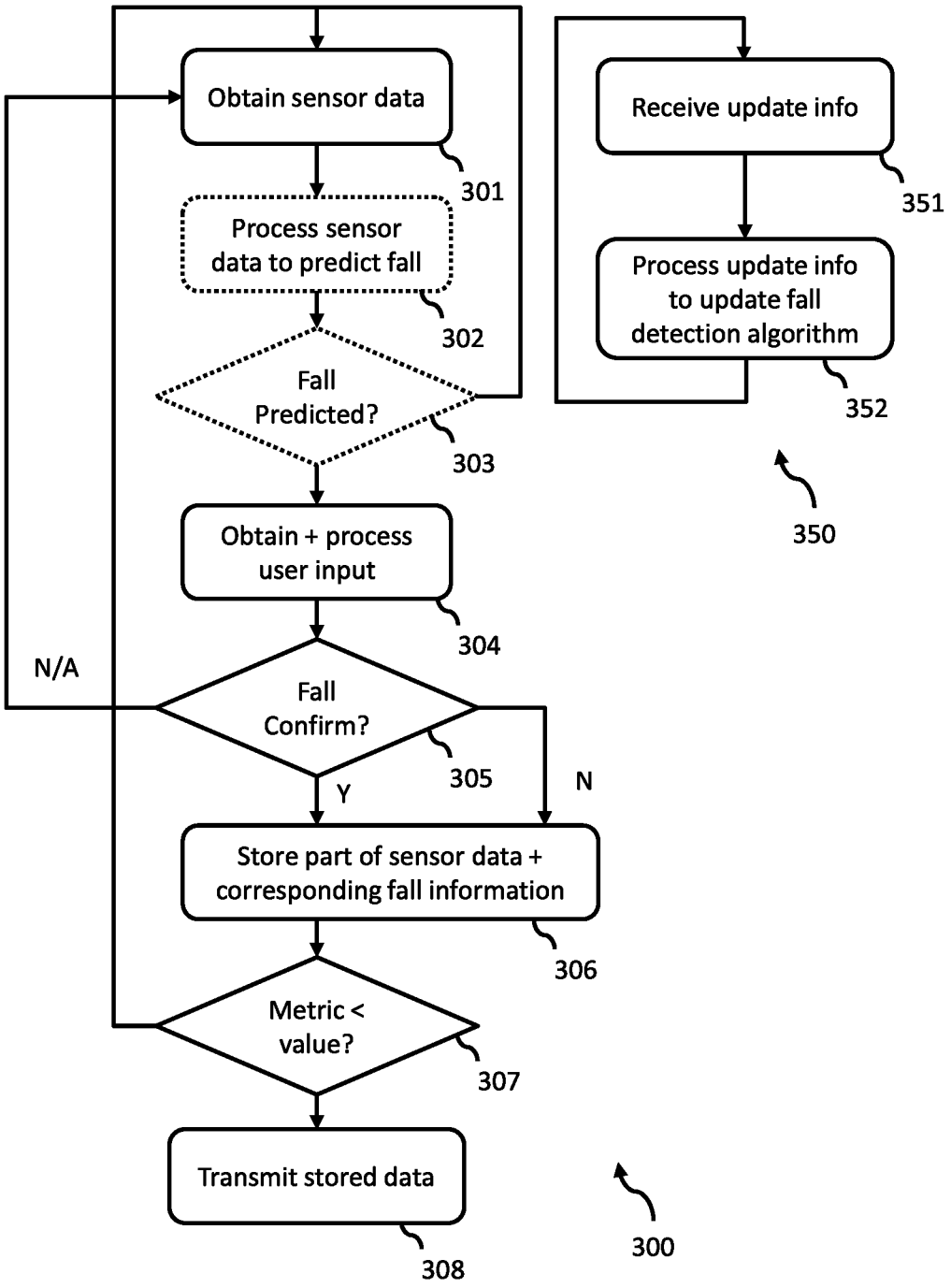
FIG. 3 is a flowchart illustrating a process performed by a fall detector for use in an embodiment of the invention.

FIG. 3 illustrates a method 300 performed by the fall detector for use in an embodiment of the invention.

The further comprises a step 301 of obtaining sensor data. Methods of obtaining sensor data (from one or more sensors), and the content of the sensor data, have been previously described, and are not repeated here for the sake of conciseness.

The method 300 further comprises optional steps 302, 303. These steps form one method of generating parts of sensor data, for transmittal to the external device, from the overall sensor data (obtained in step 301).

Step 302 comprises processing (a chunk of) the sensor data, obtained in step 301, using a fall detection algorithm to predict whether or not a fall has occurred. The processed chunk may be the most recently available chunk (e.g. most temporally recent). The size of the chunk may be a predetermined value, e.g. 10 s or 25 s.

Step 303 comprises determining whether or not a fall was detected in step 302. In response to no fall being detected, the method reverts back to step 301 of obtaining sensor data. In response to a fall being detected, the method moves to a step 304.

If steps 302 to 303 are omitted, the method moves from step 301 directly to step 304.

The step 304 comprises obtaining feedback information. The feedback information is responsive to a confirmation of whether or not there is the occurrence, or non-occurrence, of a fall.

In particular embodiments, where the steps 302 and 303 are performed, the feedback information can confirm whether or not a fall actually occurred when it was predicted to occur (e.g. whether the fall detection algorithm was accurate).

The method comprises optional steps 305 and 306. Step 305 comprises determining whether the feedback information confirms that a fall has occurred (Y), whether the feedback information confirms that no fall has occurred (N) and/or whether the feedback information does not confirm whether or not a fall has occurred (N/A).

If step 305 determines that a fall or no fall has been confirmed for the part of the sensor data, the part of the sensor data and the corresponding portion of the feedback information is stored in step 306. If, in step 305, it is not confirmed whether or not a fall has occurred, the method reverts to step 301 (and no data is stored).

It has previously been described how the feedback information may be able to indicate the occurrence of a fall, the non-occurrence of a fall or both. Steps 305 and 306 may be adapted appropriately (e.g. by removing a check for whether a fall has been confirmed or a check for whether a non-fall has been confirmed).

After this, the method 300 may move to a step 307 of determining whether a trigger has occurred. The trigger may, for example, be any previously described trigger.

In some examples, the trigger is the accuracy of the fall detection algorithm falling below a predetermined value or outside predetermined boundaries. The accuracy of the fall detection algorithm can be determined or ascertained, for example, by calculating the number of times that a confirmation (in step 305) disagrees with a prediction of whether a fall has occurred (in step 302).

In response to a trigger being identified in step 307, the method moves to a step 308 of transmitting the stored parts of the sensor data and the corresponding portions of the feedback information. The transmittal is from the fall detector to the external device.

In this way, the fall detector is able to identify appropriate parts of the sensor data, and corresponding portions of the feedback information, for training the fall detection algorithm. The training is performed by the external device, as will be later further described.

FIG. 3 also illustrates a parallel process 350 performed by the fall detector. The parallel process comprises a step 351 of obtaining update information (from the external server) and a step 352 of processing the update information to update the fall detection algorithm, By way of example, where the update information comprises new coefficients for the fall detection algorithm, step 351 may comprise obtaining the new coefficients from the external server, and step 352 may comprise updating the coefficients of the fall detection algorithm (used by the fall detector, e.g. in step 302) based on the new coefficient, e.g. replacing existing coefficients with the new coefficients.

Figure 4:
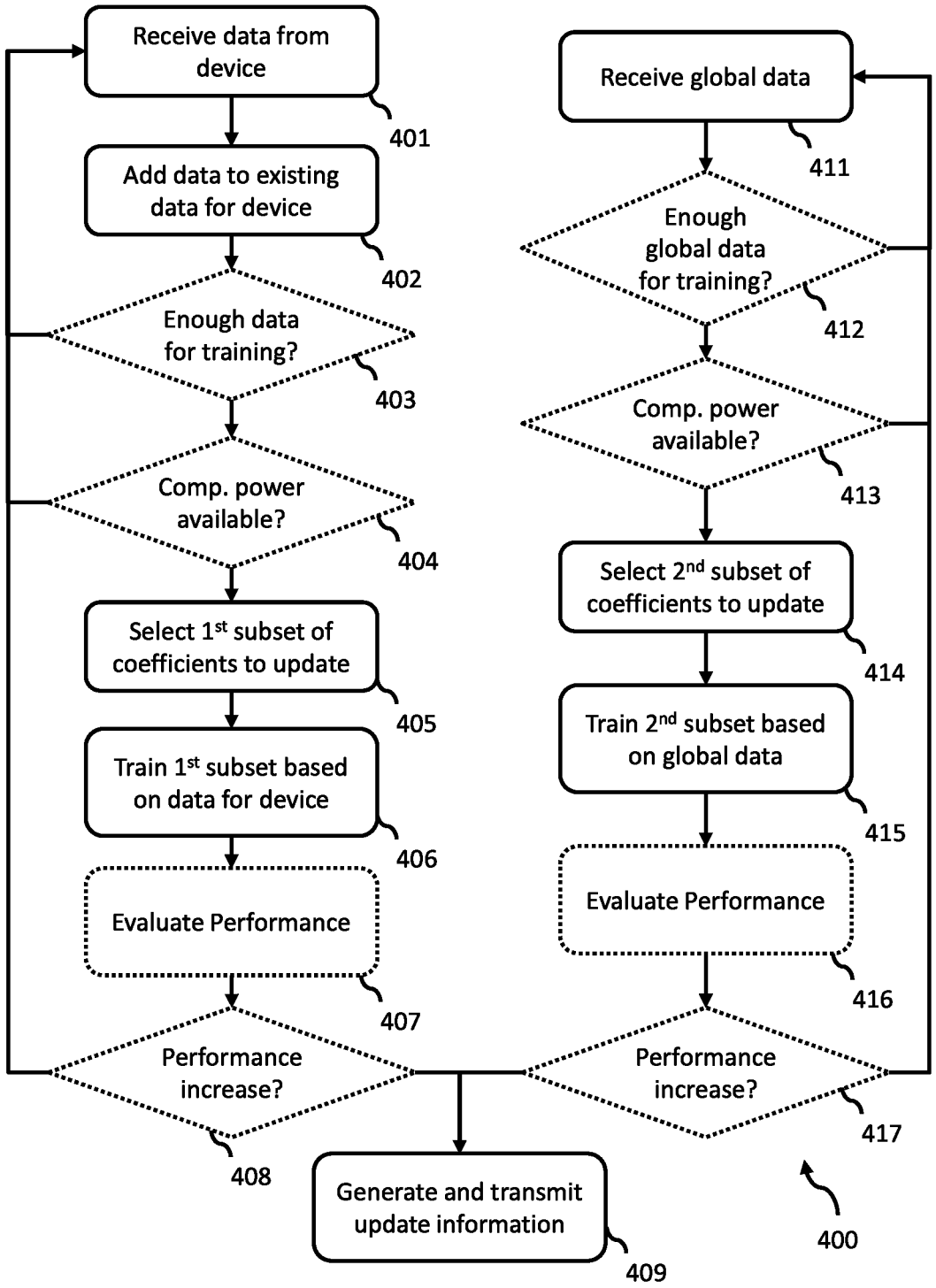
FIG. 4 is a flowchart illustrating a process performed by an external device for use in an embodiment of the invention.

FIG. 4 illustrates a method 400 performed by an external device for use in an embodiment of the invention.

It has previously been described how additional information, such as additional information obtained from other fall detectors, can be used in the generation of the update information. In the illustrated example, the overall update information is conceptually divided into two portions. First update information is generated based on data/information obtained from the fall detector (i.e. to personalize the fall detection algorithm to the specific device/subject). Second update information is generated based on the additional information, e.g. to improve the performance of the fall detection algorithm with respect to a global population, e.g. of similar devices and/or subjects.

It is not essential that both conceptual portions of the update information are sent simultaneously, rather, they may be sent when the portions are available.

Of course, the two conceptual portions of the update information may be coincident, i.e. the portions of the fall detection algorithm that they each update may overlap.

Generating the second update information is optional. In some examples, e.g. when the first update information is not available due to lack of data obtained from the fall detector, generated second update information may be transmitted to the fall detector to improve the performance of the fall detector with respect to the global population.

The method 400 comprises a step 401 of receiving data from the fall detector. The received data comprises the one or more parts of the sensor data and the corresponding one or more portions of the feedback information.

The received data is added to a bank or store of received data in a step 402 by the external device. Thus, the external device may be able to accumulate data received from the fall detector. The received data may be stored in a database or other memory module.

Optionally, a step 403 is performed. The step 403 comprises determining whether sufficient data has been received from the fall detector to further train or retrain the fall detection algorithm. Determining whether sufficient data has been received may be as simple as determining whether there are more than a predetermined number of parts of sensor data (and corresponding portions of feedback information) stored (in step 402), e.g. more than 10 parts of sensor data stores, or more than 25 parts of sensor data stored.

In response to a negative determination in step 403, i.e. there is insufficient data, the method reverts back to step 401 (i.e. waits for more data to be received from the device). In response to a positive determination in step 403, i.e. there is sufficient data, the method moves to either step 404 (which is optional) or directly to step 405.

Step 404 comprises determining whether there is sufficient computational power on the external device to further train or retrain the fall detection algorithm. Training of a fall detection algorithm is a resource-intensive process, and the computational power requirements for training an algorithm may be known. In the event that the external device is unable to train the fall detection algorithm (e.g. if it is already engaged doing the same for a different fall detector), then the method reverts back to step 401. Alternatively, the method could revert back to step 404 (i.e. wait for computational power to become available). If there is sufficient computational power, the method 400 moves to step 405. This step is optional, and can be omitted, e.g. if it is known that the external device has a sufficiently large computational complexity to (re)train the fall detection algorithm.

Step 405 comprises selecting a first subset of the fall detection algorithm to update using the data from the fall detector, e.g. a first subset of coefficients contained in the fall detection algorithm. In this way, the first subset of (coefficients for) the fall detection algorithm will be personalized for the user of the fall detector.

This selection may be predetermined (e.g. the first 4 layers of the fall detection algorithm or a middle 4 layers of the fall detection algorithm). Preferably, the layer(s) comprising the smallest number of coefficients, are selected, to minimize the amount of data sent to update the fall detection algorithm, such as the two layers comprising the smallest number of coefficients, or the three layers comprising the smallest number of coefficients. In other examples, the selection may be based upon the amount of data (of the fall detector) stored, so that the more data stored, the more of the fall detection algorithm is to be updated.

In some examples, the selection is based upon information about the subject monitoring by the fall detector and/or the fall detector itself. For example, the external device may access a database that correlates different subjects or fall detectors to different subsets of a fall detection algorithm to update.

In alternative embodiments, step 406 is omitted, and the entirety of the fall detection algorithm is updated.

After step 405, a step 406 is performed. Step 406 comprises further training or retraining the (copy of the) fall detection algorithm using on the data stored in step 402. The training may be restricted to the subset of the fall detection algorithm identified in step 405, if present.

After performing step 406, optional steps 407 and 408 may be performed. In the absence of these steps, the method moves to a step 409 after completion of step 406.

Step 407 comprises determining or predicting a performance of the (updated) fall detection algorithm. This can be performed, for example, by processing a test dataset of sensor data (for which the occurrence of falls is known) using the updated fall detection algorithm and comparing the predicted occurrence of falls to the ground truth. This approach effectively assesses the accuracy of the updated fall detection algorithm. Other methods of detecting the accuracy of a fall detection algorithm will be known to the skilled person.

Step 408 comprises determining whether the performance of the updated fall detection algorithm meets a predetermined criterion. This predetermined criterion may be an expected increase in the accuracy of the updated fall detection algorithm, compared to the original fall detection algorithm, which is greater than a predetermined value or percentage. The accuracy of the original fall detection algorithm may be stored by a database to which the external device has access, or may be transmitted from the fall detector to the external device alongside the one or more parts of the sensor data and the corresponding one or more portions of the feedback information.

In some examples, the predicted performance calculated in step 407 is stored by the external device (e.g. in a database), and can be used for future instances of determining whether the updated fall detection algorithm meets a predetermined criteria (e.g. by comparing the performance of a future updated fall algorithm to the stored predicted performance). If the predetermined criteria is met, the method moves to step 409. Otherwise, the method reverts back to step 401.

Steps 407 and 408 effectively form a step of determining whether a second trigger is present. In the illustrated example, the second trigger is that the predicted performance of the fall detection algorithm has increased by more than a predetermined amount.

Steps 407 and 408 may be replaced by or supplemented with other suitable triggers for transmittal of the update information. By way of example, an assessment as to the connectivity resources (e.g. how much data has been transferred in a predetermined time period) may be made, and the decision on whether to transmit or not transmit may be based upon the connectivity resources (e.g. if the data transferred within a predetermined time period is below a predetermined amount, e.g. less than 10 MB per a month or less than 5 MB in a week).

After steps 407 and 408 (or after step 406 if these steps are omitted), a step 409 is performed. The step 409 comprises generating and transmitting the update information to the fall detector.

Generating the update information may comprise extracting any modified coefficients from the further trained or retrained fall detection algorithm (from step 406). Thus, the update information may comprise coefficients for a first subset of the fall detection algorithm.

The steps 401-408 may be adapted to operate using global or population data, rather than simply data from the fall detector itself. This process is illustrated with steps 411-417. These steps are optional, and can be performed in parallel to the steps 401-408.

Step 411 comprises receiving or obtaining global or population data. The population data may, for example, be data obtained from other fall detectors as a same type as the original detector or monitoring demographically similar subjects to the original fall detector.

The global or population data provides one or more parts of sensor data and corresponding parts of feedback information, indicating whether or not a fall has occurred during the time period covered by the sensor data. Thus, the global or population data is suitable for training a fall detection algorithm.

Optionally, steps 412 and/or 413 may be performed. Step 412 comprises determining if there is enough global data to train the fall detection algorithm (using an analogous approach to step 403). Step 413 comprises determining whether there is sufficient computational power to update the fall detection algorithm, using an analogous approach to step 404.

Step 414 comprises selecting a second subset of the fall detection algorithm to update using the global data, e.g. a second subset of coefficients contained in the fall detection algorithm. This selection may be predetermined (e.g. the last 4 layers of the fall detection algorithm). In other examples, the selection may be based upon the amount of global data received, so that the more global data received, the more of the fall detection algorithm is to be updated.

The second subset of the fall detection algorithm is preferably separate from the first subset of the fall detection algorithm, i.e. there is no overlap between the two.

Step 415 comprises training the second subset of the fall detection algorithm using the population data.

After step 415, the method 400 may perform steps 416 and 417. In the absence of these steps, the method moves to step 409.

Step 416 comprises determining or predicting a performance of the (updated) fall detection algorithm as trained in step 415. This can be performed, for example, by processing a test dataset of sensor data (for which the occurrence of falls is known) using the updated fall detection algorithm and comparing the predicted occurrence of falls to the ground truth. This approach effectively assesses the accuracy of the updated fall detection algorithm. Other methods of detecting the accuracy of a fall detection algorithm will be known to the skilled person.

Step 417 comprises determining whether the performance of the updated fall detection algorithm meets a predetermined criteria. This predetermined criteria may, for example, be an expected increase in the accuracy of the updated fall detection algorithm, compared to the original fall detection algorithm, which is greater than a predetermined value or percentage. The accuracy of the original fall detection algorithm may be stored by a database to which the external device has access, or may be transmitted from the fall detector to the external device alongside the one or more parts of the sensor data and the corresponding one or more portions of the feedback information.

Step 409 may be appropriately adapted to generate the (overall) update information based on the fall detection algorithm trained in step 415. For example, step 409 may comprise generating first update information based on the fall detection algorithm trained in step 406 and second update information based on the fall detection algorithm trained in step 415.

The first update information comprises information for updating the corresponding subset of the fall detection algorithm on the fall detector (e.g. the first subset). The second update information comprises information for updating the corresponding subset of the fall detection algorithm on the fall detector (e.g. the second subset).

The proposed approach of using global data to train the fall detection algorithm at the external device means that data from other fall detectors is not directly shared with the original fall detector, thereby preventing the sharing of personal data between different fall detectors, thereby improving privacy.

Whilst FIG. 4 illustrates processing the population data and the data received from the fall detector separately (i.e. to update different parts of the fall detection algorithm), the method may be adapted to process both aspects of the data together, to simultaneously update the fall detection algorithm from all available information.

In some embodiments, the fall detector may itself be able to generate update information for updating at least part, e.g. less than half, of the fall detection algorithm (i.e. perform the training action of the external server). This may be useful if a communication to the external server is lost or unavailable, to ensure that the fall detection algorithm is still personalized to a user. It will be understood that it is preferred for the external device to perform the action of generating update information, as it will typically have access to improved processing power.

The external device itself may be able to handle the generation of respective update information for a plurality of different fall detectors, i.e. act as a centralized system.

The skilled person would be readily capable of developing a processing system for carrying out any herein described method. Thus, each step of the flow chart may represent a different action performed by a processing system, and may be performed by a respective module of the processing system.

Embodiments may therefore make use of a processing system. The processing system can be implemented in numerous ways, with software and/or hardware, to perform the various functions required. A processor is one example of a processing system which employs one or more microprocessors that may be programmed using software (e.g., microcode) to perform the required functions. A processing system may however be implemented with or without employing a processor, and also may be implemented as a combination of dedicated hardware to perform some functions and a processor (e.g., one or more programmed microprocessors and associated circuitry) to perform other functions.

Examples of processing system components that may be employed in various embodiments of the present disclosure include, but are not limited to, conventional microprocessors, application specific integrated circuits (ASICs), and field-programmable gate arrays (FPGAs).

In various implementations, a processor or processing system may be associated with one or more storage media such as volatile and non-volatile computer memory such as RAM, PROM, EPROM, and EEPROM. The storage media may be encoded with one or more programs that, when executed on one or more processors and/or processing systems, perform the required functions. Various storage media may be fixed within a processor or processing system or may be transportable, such that the one or more programs stored thereon can be loaded into a processor or processing system.

It will be understood that disclosed methods are preferably computer-implemented methods. As such, there is also proposed the concept of computer program comprising code means for implementing any described method when said program is run on a processing system, such as a computer. Thus, different portions, lines or blocks of code of a computer program according to an embodiment may be executed by a processing system or computer to perform any herein described method. In some alternative implementations, the functions noted in the block diagram(s) or flow chart(s) may occur out of the order noted in the figures. For example, two blocks shown in succession may, in fact, be executed substantially concurrently, or the blocks may sometimes be executed in the reverse order, depending upon the functionality involved.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. If a computer program is discussed above, it may be stored/distributed on a suitable medium, such as an optical storage medium or a solid-state medium supplied together with or as part of other hardware, but may also be distributed in other forms, such as via the Internet or other wired or wireless telecommunication systems. If the term "adapted to" is used in the claims or description, it is noted the term "adapted to" is intended to be equivalent to the term "configured to". Any reference signs in the claims should not be construed as limiting the scope.

The invention claimed is:

1. A computer-implemented method for updating, at a fall detector, a fall detection algorithm that processes sensor data to predict the occurrence of one or more fall events within the sensor data, the computer-implemented method comprising:

obtaining, at the fall detector, sensor data from one or more sensors that monitor the subject, wherein the sensor data is responsive to a fall of the subject;

obtaining, at the fall detector, feedback information that is responsive to a user or automated confirmation of the occurrence or non-occurrence of a fall;

in response to a trigger, transmitting, from the fall detector to an external device for training the fall detection algorithm:

one or more parts of the sensor data from the fall detector to the external device, each part of the sensor data corresponding to a particular time period; and a respective one or more portions of the feedback information, each portion of the feedback information temporally corresponding to the particular time period of a respective part of the sensor data, the portion of the feedback information thereby being responsive to a user or automated confirmation of the occurrence or non-occurrence of a fall during the particular time period of said respective part of the sensor data;

processing, at the external device, the one or more parts of the sensor data and the one or more portions of the feedback information to generate update information for the fall detection algorithm, wherein the update information is only usable for updating a subset of coefficients of the fall detection algorithm;

transmitting the update information from the external device to the fall detector; and updating, at the fall detector, the fall detection algorithm based on the received update information from the external device.

2. The computer-implemented method of claim 1, wherein the fall detection algorithm comprises a machine-learning algorithm formed of a plurality of layers, and the update information consists of information for updating only a subset of the plurality of layers of the machine-learning algorithm.

3. The computer-implemented method of claim 1, further comprising a step of processing, at the external device, the one or more parts of the sensor data and the one or more portions of the feedback information to determine which part of the fall detection algorithm to update.

4. The computer-implemented method of claim 1, further comprising a step of processing, at the fall detector, sensor data using the fall detection algorithm to predict the occurrence of a fall event within the sensor data, wherein each one or more parts of the sensor data comprises a part of the sensor data corresponding to a predicted fall event within the sensor data.

5. The computer-implemented method of claim 4, wherein each one or more parts of the sensor data comprises a part of the sensor data corresponding to a portion of the feedback information that indicates a user or automated confirmation of the occurrence or non-occurrence of a fall.

6. The computer-implemented method of claim 1, wherein the trigger comprises:

a user input from a user interface indicating a desire to update the fall detection algorithm;

the feedback information indicating confirmation of the occurrence or non-occurrence of a fall more than a first predetermined number of times, wherein the first predetermined number of times is greater than one;

the feedback information indicating confirmation of the occurrence or non-occurrence of a fall more than a second predetermined number of times within a first predetermined time period, wherein the second predetermined number of times is greater than one; and/or a signal received from the external server.

7. The computer-implemented method of claim 1, further comprising:

a step of processing, at the fall detector, sensor data using the fall detection algorithm to predict the occurrence of a fall event within the sensor data; and processing the predicted occurrences of a fall event and the feedback data to calculate an accuracy measure of the fall detection algorithm; and wherein the trigger comprises the accuracy measure falling outside a first predetermined range.

8. The computer-implemented method of claim 1, wherein the step of transmitting the update information is performed responsive to a second trigger.

9. The computer-implemented method of claim 8, further comprising a step of determining a total amount of data transferred to the fall detector within a second predetermined time period, wherein the second trigger comprises the total amount of data being below a second predetermined value.

10. The computer-implemented method of claim 8, further comprising a step of, at the external device, processing the update information to predict an expected increase in performance of the fall detection algorithm, wherein the second trigger comprises the expected increase being greater than a third predetermined value.

11. A computer program comprising code means for implementing the method of claim 1 when said program is run on a processing system.

12. A fall detection system for updating, at a fall detector, a fall detection algorithm that processes sensor data to predict the occurrence of one or more fall events within the sensor data, the fall detection system comprising:

the fall detector comprising:

one or more sensors that monitor the subject to generate sensor data wherein the sensor data is responsive to a fall of the subject;

a fall detection processor adapted to process the sensor data, using a fall detection algorithm, to predict the occurrence of one or more fall events within the sensor data;

an interface adapted to obtain feedback information that is responsive to a user or automated confirmation of the occurrence or non-occurrence of a fall;

a transceiver system adapted to, in response to a trigger, transmit, from the fall detector to an external device:

one or more parts of the sensor data from the fall detector to the external device, each part of the sensor data corresponding to a particular time period; and a respective one or more portions of the feedback information, each portion of the feedback information temporally corresponding to a particular time period of a respective part of the sensor data, the portion of the feedback information thereby being responsive to a user or automated confirmation of the occurrence or non-occurrence of a fall during the particular time period of said respective part of the sensor data; and the external device for training a fall detection algorithm, the external device being adapted to:

process the one or more parts of the sensor data and the one or more portions of the feedback information to generate update information for the fall detection algorithm, wherein the update information is only usable for updating a subset of coefficients of the fall detection algorithm; and transmit the update information from the external device to the fall detector, wherein the transceiver system of the fall detector is further adapted to receive the update information and the fall detector is adapted to, update the fall detection algorithm based on the received update information from the external device.

* * * * *